US008032977B2

(12) United States Patent
Coombs

(10) Patent No.: US 8,032,977 B2
(45) Date of Patent: Oct. 11, 2011

(54) AIR MOVING DEVICE AND METHOD OF MAKING

(76) Inventor: Richard Coombs, Boise, ID (US)

( * ) Notice: Subject to any disclaimer, the term of this patent is extended or adjusted under 35 U.S.C. 154(b) by 803 days.

(21) Appl. No.: 11/967,764

(22) Filed: Dec. 31, 2007

(65) Prior Publication Data

US 2009/0019660 A1 Jan. 22, 2009

Related U.S. Application Data

(60) Provisional application No. 60/950,526, filed on Jul. 18, 2007.

(51) Int. Cl.
*A47L 5/00* (2006.01)

(52) U.S. Cl. ..... 15/300.1; 15/347; 15/353

(58) Field of Classification Search ..... 15/347, 15/353, 300.1

See application file for complete search history.

(56) References Cited

U.S. PATENT DOCUMENTS 7,610,654 B2 * 11/2009 Lee et al. ..... 15/353
2007/0234504 A1 * 10/2007 Bott et al. ..... 15/347

* cited by examiner

*Primary Examiner* — Joseph J Hail
*Assistant Examiner* — Shantese McDonald
(74) *Attorney, Agent, or Firm* — Robert L. Shaver; Dykas & Shaver, LLP

(57) ABSTRACT

The invention is a device and a method for manufacturing the device, namely an air moving device, such as a vacuum cleaner, yard air blower, or other air moving machinery. The device and method involves using compressible foam, molded into appropriate configurations to secure the mechanical components, such as the motor and fan, inside a housing for operation. In most cases the method would involve enclosing an Air Moving Motor and its supporting components between two molded pieces of foam. The foam would conform to significant features on the motor or accompanying devices. The assembly will be placed into a molded housing, using the housing to encase the assembly.

10 Claims, 9 Drawing Sheets

AIR MOVING DEVICE AND METHOD OF MAKING

CROSS-REFERENCE TO RELATED APPLICATIONS

This application claims the priority date of the provisional application entitled "Functional Encapsulation Patent" filed by Richard L. Coombs on Jul. 18, 2007 with application Ser. No. 60/950,526.

FIELD OF THE INVENTION

The invention relates generally to an apparatus and method for simple and inexpensive manufacture of mechanical air moving devices, and more particularly to vacuum cleaners, yard air blowers, and other air moving machinery.

BACKGROUND OF THE INVENTION

Air moving apparatus such as vacuum cleaners, blowers, and other air conveyance devices have seen various technological advances since their first invention. Modern air conveyance devices are complex and contain a great number of component parts. The manufacture of these types of devices requires skilled labor and complex manufacturing machinery. Numerous fasteners are used to attach all of the components into a single functioning device. Overall, an appreciable amount of expense is required to assemble and test each device before it is ready for sale.

The cost of tooling and labor required to construct conventional air moving devices is considerable. High cost of manufacturing inevitably drives the cost of the final product higher. The skilled labor needed to assemble complex devices is costly and time consuming to train. Manufacturers also have difficulty in retaining a trained work force at profitable salaries. Additionally, a large number of various component parts in an air moving device may require numerous manufacturing steps. A large number of manufacturing steps and different component parts involved in constructing these devices creates an added expense in tooling costs required when setting up, maintaining, and operating a manufacturing facility.

With increased competition in global manufacturing markets, cost and efficiency related issues arise when manufacturing conventional air moving devices. Manufacturers must develop highly efficient and low cost means of production. This need requires abandoning conventional manufacturing techniques and product designs that are labor intensive and require a high number of component parts. A need exists for a method of manufacture and simple design of an air moving device that reduces the need for highly trained labor, decreases expensive tooling cost, and reduces the number of parts in order to efficiently produce high quality air moving devices. This need is met by a novel product design and method of manufacture that minimizes manufacture time, labor cost, material costs, tooling costs, and results in a high quality product.

SUMMARY OF THE INVENTION

The invention disclosed is an air moving device and a method of making an air moving device in a manner that greatly reduces the required number of parts and simplifies the steps of assembly. The simplicity of the design of the air moving device significantly reduces the manufacturing costs. The design of the air moving device also reduces the amount of noise that is allowed to propagate from the device housing.

The air moving device may be constructed in a number of embodiments including an upright, canister, belt, handheld, or backpack vacuum. The air moving device may also be configured as a blower or a variety of other pneumatic conveyance apparatuses, such as a yard and leaf blower, an industrial air mover, a household fan, a furnace fan, an automotive fan, or other air moving devices The core of the air moving device is a block assembly constructed of molded, compressible, foam that encapsulates a motor/fan assembly. The compressible foam assembly not only functions to encapsulate the motor/fan assembly, but also contains an integrated air conveying chamber. The air conveying chamber is molded into the compressible foam assembly with an air outlet path and an air inlet path located at different points on the surface of the compressible foam assembly. The motor/fan assembly within the compressible foam assembly draws air in the air inlet path and pushes air out the air outlet path.

The core of the air moving device is comprised of a compressible foam assembly that is enclosed by a device housing that may take forms such as those listed above, including an upright, canister, or backpack vacuum, or a blower or other conceivable pneumatic conveyance apparatus.

In one manner of constructing the air moving device, the compressible foam assembly core is constructed of molded, compressible, foam blocks that fit together, thus encapsulating a motor/fan assembly. Fitting the compressible blocks together not only functions to encapsulate the motor/fan assembly, but also forms an air conveying chamber. Part of the air conveying chamber is molded into the face of each of two compressible foam blocks. Alternatively, more than two blocks could be used or the foam block could be injected into the housing around the other components of the device.

A motor/fan engagement structure is also molded into the face of each compressible foam block to allow placement of the electric motor/fan assembly within the air conveying chamber. This motor/fan engagement structure is partially formed on each compressible foam block, so that when the blocks are fitted together, the motor/fan assembly is held securely in the middle of the air conveying chamber. The motor/fan assembly is placed in a manner that enables it to draw air through the air conveying chamber from the air inlet path on the outside of the compressible foam block assembly and push air to an air outlet path at another point on the outside of the compressible foam block assembly. The mated faces of the compressible foam blocks are made air tight around the periphery of the air conveying structure and the motor/fan assembly, by compressing the blocks together.

Additionally, the faces of the compressible foam blocks are molded so that the air conveying chamber has a serpentine shape between the air inlet path and the air outlet path, when the compressible foam blocks are mated together. This shape functions to dampen noise generated by the motor/fan assembly.

Further assembly of the device involves placing the mated compressible foam blocks, which encapsulate the motor/fan assembly, into the device housing. The device housing provides the overall structure and configuration of the air conveying device. The device housing can have separate portions that join together and encapsulate different outside surfaces of the compressible foam block assembly. Within the device housing, other components of the device may be placed around the foam block assembly. These other components may be objects such as wiring, power switches, filters, and air transmitting refuse collectors. These components are selectively placed into devices configured for specific purposes such as vacuuming, blowing, or other air conveying functions. These other components are placed adjacent the compressible foam blocks assembly in a tight fitting manner in order to eliminate the need of fasteners.

Once all of the parts of the air moving device are assembled, the separate portions of the device housing are sealed around the core components of the device including the compressible foam assembly. The completed device housing assembly functions to compress the foam block halves together as well as hold the other components together with a tight fit so that no fasteners are needed for assembly.

The assembled product allows the motor/fan assembly to draw air into an air inlet port on the surface of the device housing assembly. Air may then be drawn though an air transmitting refuse collector if the device is a vacuum cleaner, or the air may be drawn through a filter. The air then is drawn into the air inlet path of the compressible foam block assembly. The air is next drawn through part of the air conveying chamber and into the motor/fan assembly. The air is then discharged from the motor/fan assembly and pushed through another part of the air conveying chamber of the compressible foam block assembly. The air is then pushed out the air outlet path of the compressible foam block assembly may be pushed through a filter, depending on the intended purpose and construction of the invention. The air is then pushed out of an air outlet port on the surface of the air moving device housing.

The purpose of the foregoing Abstract is to enable the public, and especially the scientists, engineers, and practitioners in the art who are not familiar with patent or legal terms or phraseology, to determine quickly from a cursory inspection, the nature and essence of the technical disclosure of the application. The Abstract is neither intended to define the invention of the application, which is measured by the claims, nor is it intended to be limiting as to the scope of the invention in any way.

Still other features and advantages of the present invention will become readily apparent to those skilled in this art from the following detailed description describing preferred embodiments of the invention, simply by way of illustration of the best mode contemplated by carrying out my invention. As will be realized, the invention is capable of modification in various obvious respects all without departing from the invention. Accordingly, the drawings and description of the preferred embodiments are to be regarded as illustrative in nature, and not as restrictive in nature.

DESCRIPTION OF THE PREFERRED EMBODIMENTS

Figure 1:
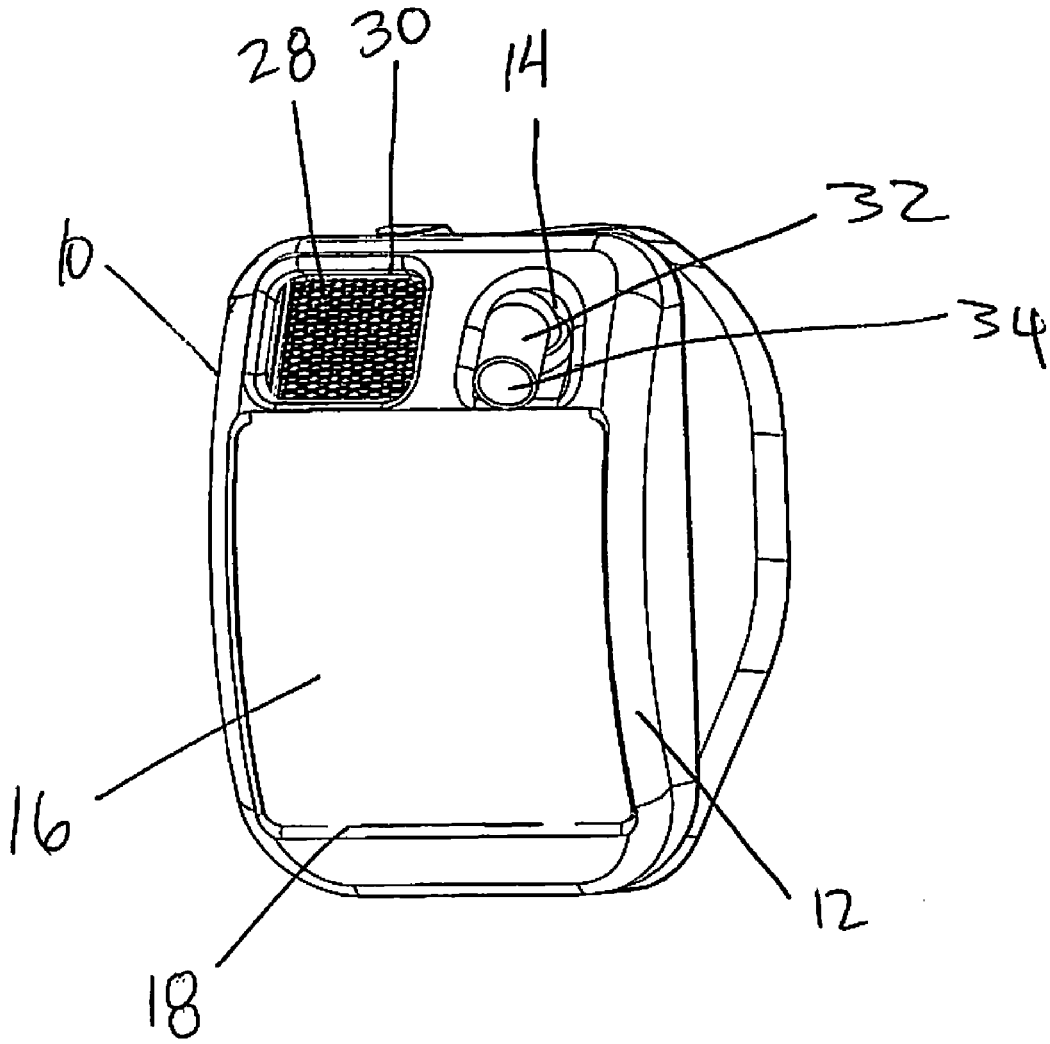
FIG. 1 Illustrates a front view of the assembled device for which the construction and method of assembly are described.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

The industry manufacturing conventional air moving devices such as vacuum cleaners, air blowers, fans, or other air conveyance devices has produced devices that are manufactured with a high number of component parts. This requires skilled labor, lengthy production time, high tooling costs, and high cost of final products. A need for a simple and effective product design and method of manufacture for a variety of configurations of air moving devices is needed to reduce manufacturing costs of air moving devices. Filling this need increases business profitability in the global manufacturing marketplace and provides effective and more affordable air moving devices.

The device and the method of manufacture and product design disclosed herein solves the problems related to the high cost of manufacturing previously known to the air moving device industry. The invention disclosed herein show a simple air moving device design and method of construction utilizing a minimum number of component parts and assembly steps. This is achieved by producing an air conveying device with a core composed of two high temperature, compressible, foam block halves in which a motor/fan assembly and an air conveyance chamber is enclosed. This foam block assembly is mated with other component parts such as wiring, switches, filtration, or dust collection. All of the parts are snuggly fitted into an external, air moving device housing. Assembly of the device does not require special tools, nor does the device require fasteners to hold the parts together. All of the parts fit tightly together within the housing which snaps together to produce a finished product. This construction allows a relatively untrained assembler to quickly fit the simple pieces together into a working finished product, thereby reducing manufacturing and product costs.

Rather than using two block halves that fit together the foam blocks can also be cast in place surrounding the motor/fan assembly by injecting foam into the housing. The wiring and power switch can be in place within the housing before such an injection process.

In the following description and in the figures, like elements are identified with like reference numerals. The use of "or" indicates a non-exclusive alternative without limitation unless otherwise noted. The use of "including" means "including, but not limited to," unless otherwise noted.

The illustration in FIG. 1 represents a front view of the preferred embodiment of the invention in its fully assembled form. The embodiment of the device is that of a vacuum apparatus 10. The housing 12 and lid 16 of the vacuum constitute the largest portion of the device which is configured in this embodiment as a backpack style vacuum. The housing 12 holds the majority of the components of the device and is sealable with the lid 16 to secure all of the components within the housing. The lid 16 seals across the front of the housing and is shaped to mate with the housing opening 18. The housing opening is a large portal through which component parts of the vacuum device may be passed into or out of the housing. The lid 16 is secured over the housing opening by inserting the four lid tabs 20 into four tab slots 22 in the bottom and the upper edges of the housing opening 18 (shown in FIG. 2). Inserting the tabs 20 into the tab slots 22 seals the lid around the periphery of housing opening 18.

Figure 3:
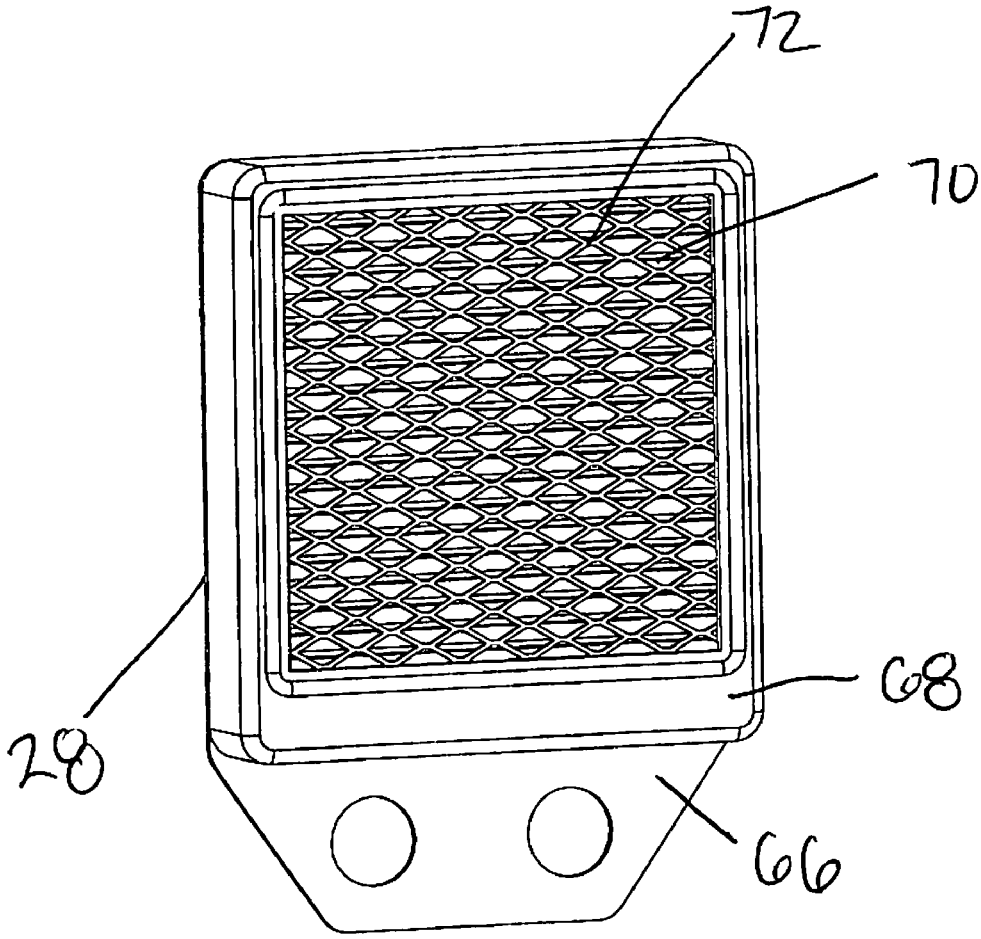
FIG. 3 Illustrates a front view of the filter assembly portion of the invention.

The upper half of the housing as represented in FIG. 1 has two additional openings. One opening is a filtered airflow outlet 30. The filtered airflow outlet allows air to pass out of the housing when the vacuum is operated. A filter assembly 28, shown in FIG. 3, is positioned and held in place just below the periphery of the filter airflow outlet 30. This filter assembly 28 functions to allow air to pass out of the device while filtering particulate matter from the device's internal airstream. Another opening on the upper half of the device is the housing airflow inlet 14. The housing airflow inlet functions to allow the air to be drawn into the device while the vacuum apparatus 10 is in operation. An attachment elbow 32 may pass through the housing airflow inlet 14. The elbow has an elbow airflow inlet 34 which is on the opposite end of the elbow from the end of the elbow that is inserted into the housing airflow inlet 14. Air is drawn in the elbow airflow inlet 34 when the vacuum is in operation. The elbow airflow inlet 34 functions to allow attachment of hosing or other various tools that are used in vacuuming.

Figure 2:
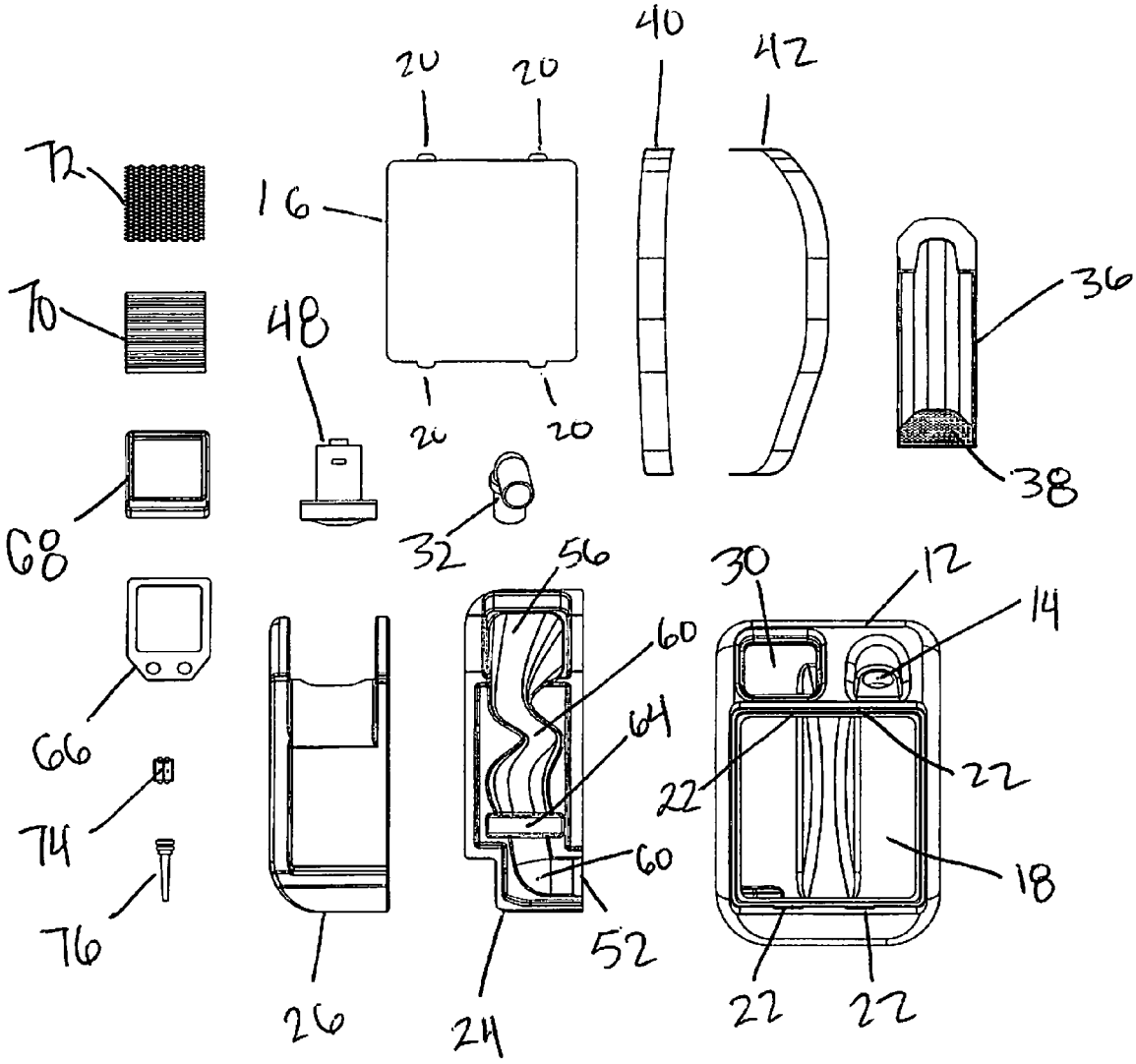
FIG. 2 Illustrates a front view of the disassembled device for which the construction and method are described.

The illustrations in FIG. 2 are a front perspective of the disassembled view of the internal and external components of the device. FIG. 2. Illustrates the front face of the first compressible foam block 24 and the front side of the second compressible foam block 26. FIG. 2 also illustrates the other components of the device. These are the lid 16, the device housing 12, the dust bag chamber 36, the airflow inlet elbow 32, the motor/fan assembly 48, the first harness strap 40, the second harness strap 42, the power switch 74, the power cord strain reliever 76, the filter assembly filter grating 72, the filter assembly plate 66, the pleated filter medium 70, and the filter case 68.

The illustration in FIG. 3 displays the filter assembly 28 in its assembled configuration. The back side of the filter assembly 28 is composed of the filter plate 66 with a void space in its center. The construction of the filter assembly is such that the pleated filter medium 70 is placed on top of the filter plate 66. A filter grating 72 is then placed on top of the pleated filter medium 70. A filter casing 68 is the placed around the periphery of the pleated filter medium 70 and the filter grating 72, such that the filter casing 68 fixes the pleated filter medium 70 and the filter grating 72 to the filter plate 66. Air may pass through the void space of the filter plate 66, and through the pleated filter medium 70 and filter grating 72. Besides the pleated filter shown, other filter modes may be used with the device and method of the invention, including but not limited to bag filters, vortex, centrifugal filters, and other filtration mechanisms.

Figure 4:
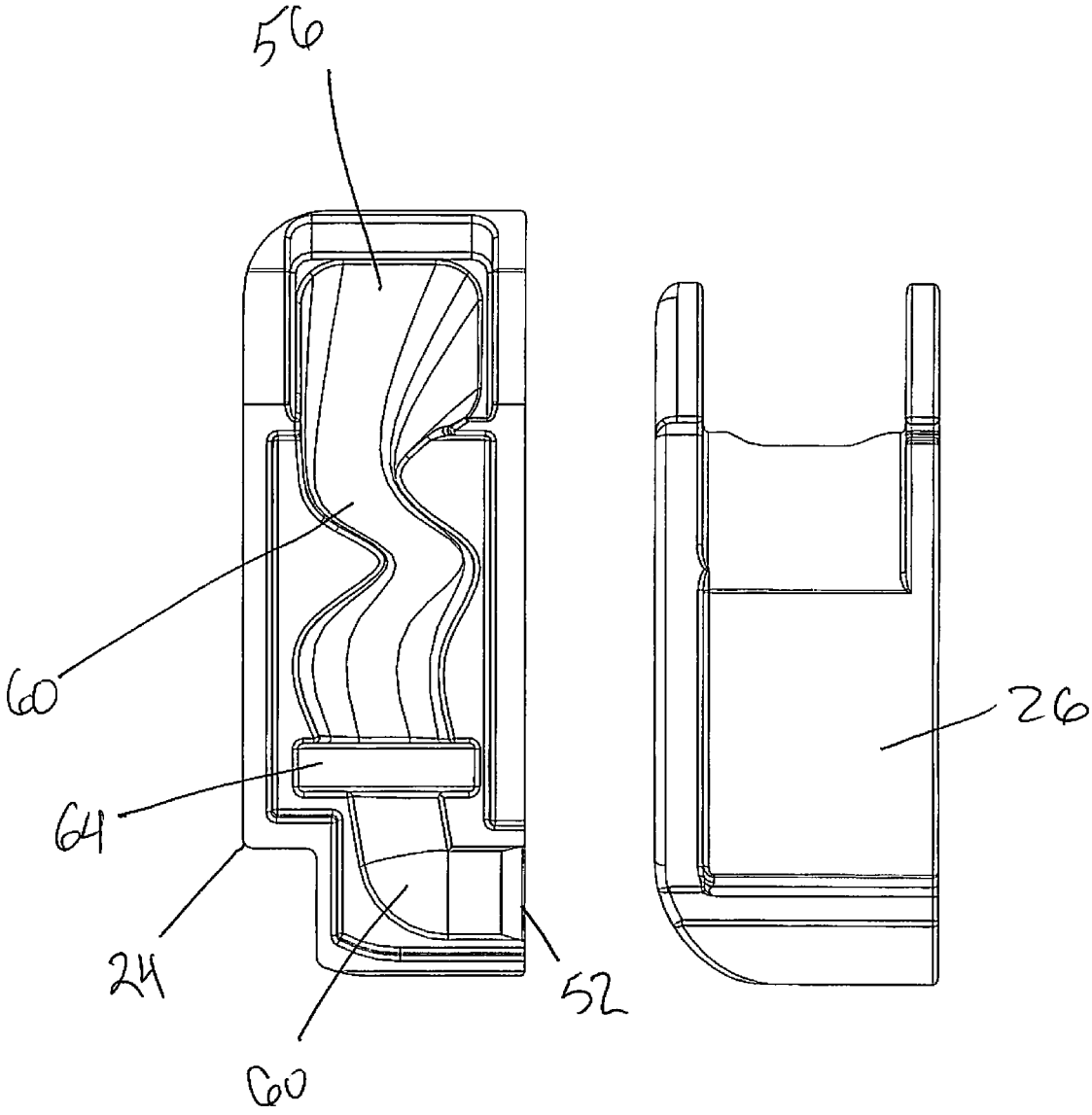
FIG. 4 Illustrates a view of the front face of the first compressible foam block with the molded half of the air conveying chamber visible, as well as the front side of the second compressible foam block.

The illustration in FIG. 4 is a view of the front face of the first compressible foam block 24 and a view of the front side of the second compressible foam block 26. Several functional aspects of the first compressible foam block 24 are visible on its front face as seen in FIG. 4. These functional aspects are molded at the time of the first compressible foam block's 24 manufacture. These functional aspects are a first compressible foam block air inlet molded half 52, a molded half of the air conveying chamber 60, a molded half of the motor engagement structure 64, a continuation of the molded half of the air conveying chamber 60, and a first compressible foam block molded half of the air outlet 56.

Figure 5:
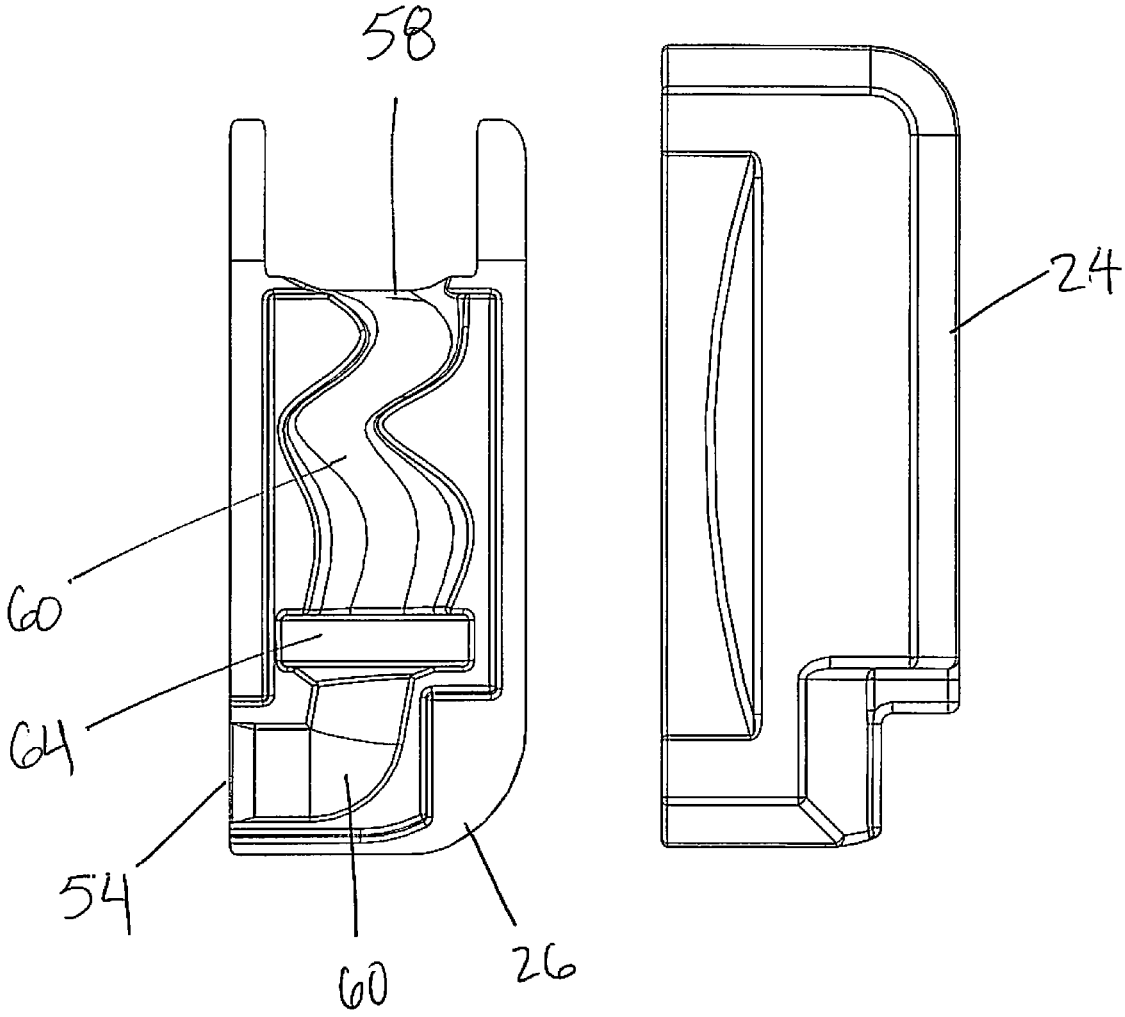
FIG. 5 Illustrates a view of the back side of the first compressible foam block, as well as the back face of the second compressible foam block with the molded half of the air conveying chamber visible.

The illustrations within FIG. 5 are a view of the back side of the first compressible foam block 24 and a view of the back face of the second compressible foam block 26. The back face of the second foam block 26 contains a mirror image configuration of the same functional aspects that are molded into the front face of the in the first foam block 24 as illustrated in FIG. 4. The functional aspects of the second foam block 26 are a second compressible foam block air inlet molded half 54, a molded half of the air conveying chamber 60, a molded half of the motor engagement structure 64, a continuation of the molded half of the air conveying chamber 60, and a second compressible foam block air outlet 58.

When viewing FIGS. 4 and 5 it is important to note that a portion of the air conveying chamber 60 that is molded into the face of each compressible foam block half is constructed in a manner that is serpentine in shape. When the first and second compressible foam blocks mated together, the air conveying chamber that is formed is a curved or sinusoidal passageway that dampens noise generated by the motor/fan assembly 48. It is important to note that the whole air conveying chamber 60, as well as the whole air inlet and outlet are constructed when the front face of the first compressible foam block 24 and the back face of the second compressible foam block 26 are mated together into a compressible foam block assembly 62.

Figure 6:
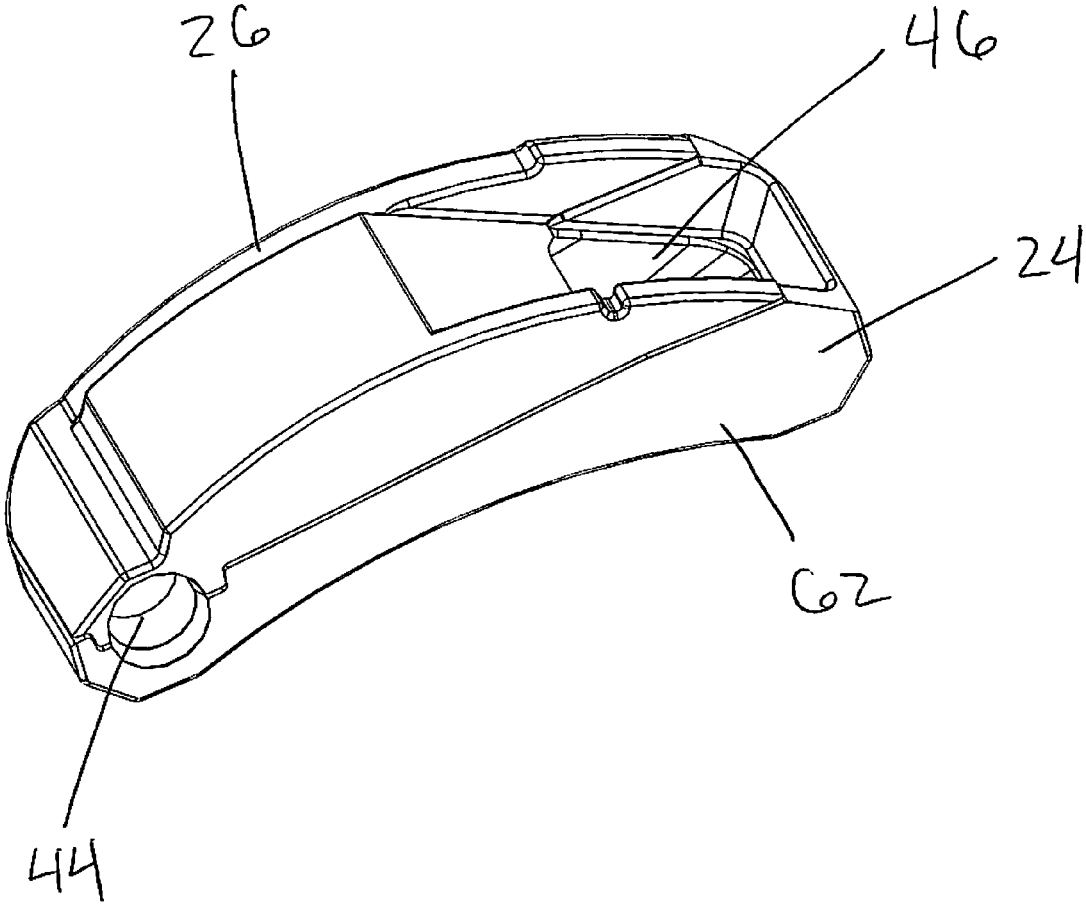
FIG. 6 Illustrates a perspective view of the combined first and second compressible foam blocks.

The illustration in FIG. 6 is a perspective representation of the first compressible foam block 24 and the second compressible foam block 26 mated together to form a compressible foam block assembly 62. Again, the front face of the first compressible foam block 24 is mated with the back face of the second compressible foam block 26. This combination constitutes a compressible foam block assembly 62. As stated above the front face of the first compressible foam block 24 and the back face of the second compressible foam block 26 are molded in mirror images of one another so that the air conveying chamber 60, the motor engagement structure 64, and the inlet and outlet molded halves of each compressible foam block align and seal against one another. The mirror image molding construction provides an air tight fit when the first and second foam blocks are mated and compressed together. Thus the joining of the two compressible foam blocks forms a compressible foam block assembly air inlet path 44, a compressible foam block assembly air outlet path 46, a complete motor engagement structure 64, and a complete air conveying chamber 60.

Figure 7:
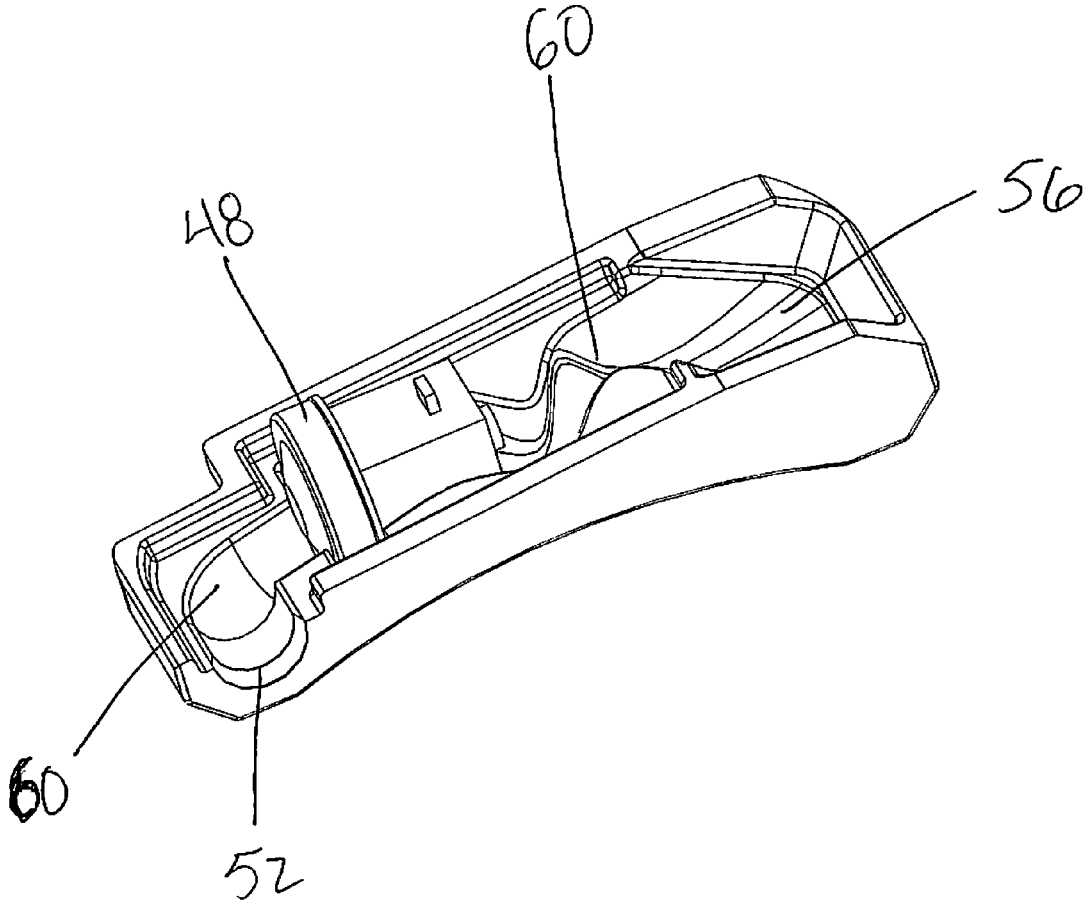
FIG. 7 Illustrates a perspective view of the first compressible foam block with the motor/fan assembly placed in the motor engagement structure of the first compressible foam block.

The illustration in FIG. 7 is a perspective view the first compressible foam block 24 with the motor/fan assembly 48 placed within the molded half of the motor engagement structure 64. The outer surface of the motor/fan assembly 48 contains orienting tabs 50 that provide additional support for the motor/fan assembly while in operation. The orienting tabs 50 fit into slots in the front face of the first compressible foam block and the back face of the second compressible foam block. This functions to keep the motor/fan assembly 48 stationary while the motor mechanism within the motor/fan assembly 48 is spinning and generates torque forces.

Assembly of the vacuum device requires placing the first compressible foam block 24 vertically within the left side of the housing 12. The first compressible foam block 24 is placed in contact within the housing 12 so that the back side of the first compressible foam block contacts the rear inside wall of the housing. The first compressible foam block air inlet molded half 52 is oriented at the bottom end of the housing 12 and the first compressible foam block air outlet molded half 56 is aligned in the upper half of the housing with the filtered airflow outlet 30. From this configuration, the front face of the first compressible foam block containing the molded half of the air conveying chamber 60 and the molded half of the motor engagement structure 64 is visible and accessible through the housing opening 18.

Once the first foam block 24 is correctly positioned within the housing 12, the motor/fan assembly 48 may be placed in the motor engagement structure 64 molded half of the first compressible foam block 24. After the motor/fan assembly 48 is properly seated in the molded half of the motor engagement structure 64 of the first compressible foam block 24, and the orienting tabs 50 of the motor/fan assembly 48 are secured within the front face of the first compressible foam block, the wiring may be connected to the motor/fan assembly 48. The wiring may pass through channels within the first compressible foam block 24 and connect to a power switch 74 that is mountable to and accessible on the outside of the housing 12. Once the wiring and the switching mechanism are in place the device is wired for connection to a power supply. An external power supply cord attaches to the power switch 74 and passes through a hole in the housing. The external power supply cord is attached to the housing by a conical cord strain reliever 76 that relieves tension stress at the junction between the external power supply cord and the housing 12.

The second compressible foam block may be placed within the housing once the first foam block 24, the motor/fan assembly 48, the wiring, and power switch 74 are placed within the housing 12. The second foam block may be inserted into the housing 12 through the housing opening 18. The second foam block is aligned with the first foam block so that the second compressible foam block air inlet molded half 54 is aligned with the first compressible foam block air inlet molded half 52 at the bottom end of the housing. Additionally, the second compressible foam block air outlet molded half 58 is aligned with the first compressible foam block air outlet molded half 56. This alignment insures that the compressible foam block assembly air outlet path is aligned with the filtered airflow outlet 30 of the housing 12.

After partial placement of the second compressible foam block 26 within the housing, the motor engagement structure 64 of the second foam block 26 is tightly secured to the top of the motor/fan assembly 48. The remaining edges of the two foam blocks are mated together. Thereafter, compressing the two blocks together forms the compressible foam block assembly 62 with the complete air conveying chamber 60, complete compressible foam block assembly air inlet path 44 inside the housing's bottom end, and the compressible foam block assembly air outlet path 46 aligned with the filtered airflow outlet 30 at the top end of the housing 12.

Once the compressible foam block assembly 62, motor/fan assembly 48, wiring, and power switch 74 are placed within the housing 12, the other components of the vacuum may be placed within the housing. It is important to note that no additional fasteners are needed to assemble the device and that all of the component parts of the device fit tightly into housing, thereby holding one another into place.

The filter assembly 28 is slid into place within the housing 12, between the filtered airflow outlet 30 and the compressible foam block assembly air outlet 46. A groove is provided on the front side of the second compressible foam block 26 to allow insertion of the filter assembly 28.

The dust bag chamber 36 is placed within the right side of the housing 12, opposite the compressible foam block assembly 62. The dust bag chamber 36 functions to hold a conventional vacuum filter bag within the housing. The dust bag chamber 36, illustrated in FIG. 2, is a semi-tubular structure with a dust bag chamber grating 38 forming its bottom end and a collar forming its top end. One side of the dust bag chamber's 36 semi-tubular structure is open to allow access to a vacuum filter bag.

The dust bag chamber 36 is placed within the housing 12 so the collar at the top end of the dust bag chamber fits closely to the housing airflow inlet 14 located at the upper end of the device housing 12. The collar accepts the inserted end of the elbow 32 when it is placed though the housing airflow inlet 14. The collar also functions to accept the opening of a conventional vacuum filter bag.

The dust bag chamber grating 38 located at the bottom of the bag chamber 36, functions to support a filter bag placed within the bag chamber while also allowing air flow. Installation of the dust bag chamber 36 within the housing 12 orients the bottom end of the dust bag chamber 36 and the dust bag chamber grating 38 adjacent to the compressible foam block assembly air inlet 44, which is also in the bottom end of the device housing. This allows air to flow freely through the dust bag chamber grating 38 and into the compressible foam block assembly air inlet.

Placement of the lid 16 over the housing opening 18 functions to further compress the compressible foam block assembly 62, insuring an air tight fit between the first and second compressible foam blocks and to insure that the motor/fan assembly generates adequate vacuum through the air conveying chamber 60. The lid 16 is held in place by a series of lid tabs 20 molded around the periphery of the lid. These tabs correspond to tab slots 22 that are cut around the periphery of the housing opening 18. Inserting all of the lid tabs 20 into the tab slots 22 insures that the lid is held securely in place in an airtight manner, thus completing the assembly of the device.

When switched on, the motor/fan assembly draws air into the sealed device housing 12 at the housing airflow inlet 14 and discharges air out of the filtered airflow outlet 30. The path of the air though the vacuum device is as follows: air is vacuumed into the housing airflow inlet 14 through the elbow. The air then passes into the dust bag chamber 36 which contains a filter bag. The filter bag collects and traps any debris carried within the air stream. The air is then drawn through the porous surface of the conventional filter bag and through the dust bag chamber grating 38 in the bottom of dust bag chamber 36. The air then passes from the base of the dust bag chamber to the compressible foam block assembly air inlet path 44. The air then passes into the first part of the air conveying chamber 60 within the compressible foam block assembly 62. The air is then pulled through the motor/fan assembly and discharged into the second part of the air conveying chamber 60 within the compressible foam block assembly 62. The air passes through the serpentine passageway of the air conveying chamber 60 and through the air outlet path of the compressible foam block assembly 62. The air then passes through the filter assembly 28, trapping any remaining particulate matter that was not trapped by the conventional filter bag. The air is then discharged from the device housing 12 through the filtered airflow outlet 30.

Figure 8:
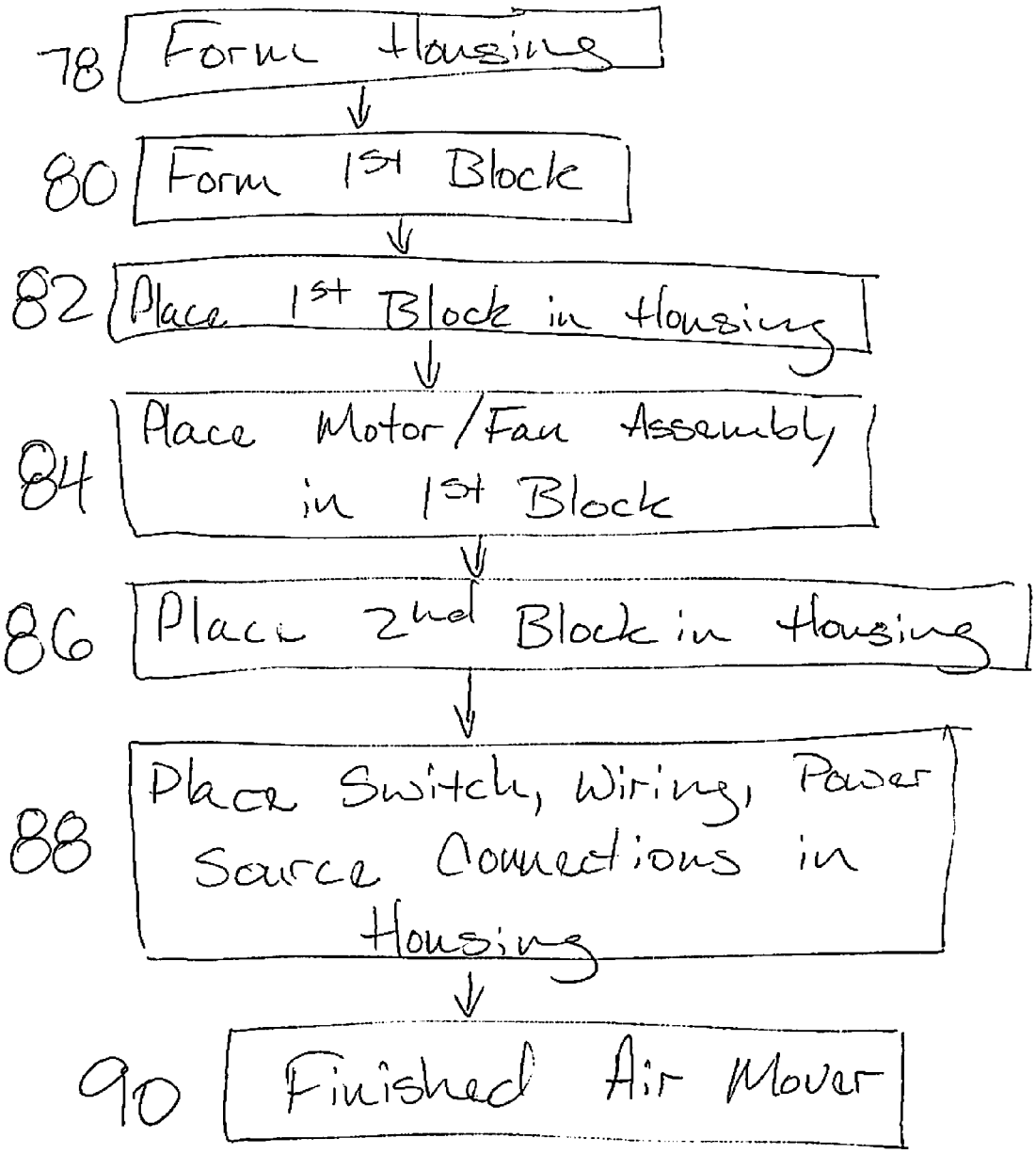
FIG. 8 is a logic diagram for the method of constructing the air moving device by forming the foam block assembly with two foam block halves.

FIG. 8 is a logic flow diagram for the above described method of assembling an air moving device. Step 78 involves forming the device housing. Step 80 includes forming the first block. Step 82 involves placing the first block within the device housing. Step 84 involves placing the motor/fan assembly within the first block. Step 86 involves placing the second block in corresponding contact with the first foam block in the housing. Step 88 involves placing the switch, wiring, and power source connections within the housing so that all of the components are correctly wired. A step 90 the air moving device is completed.

Figure 9:
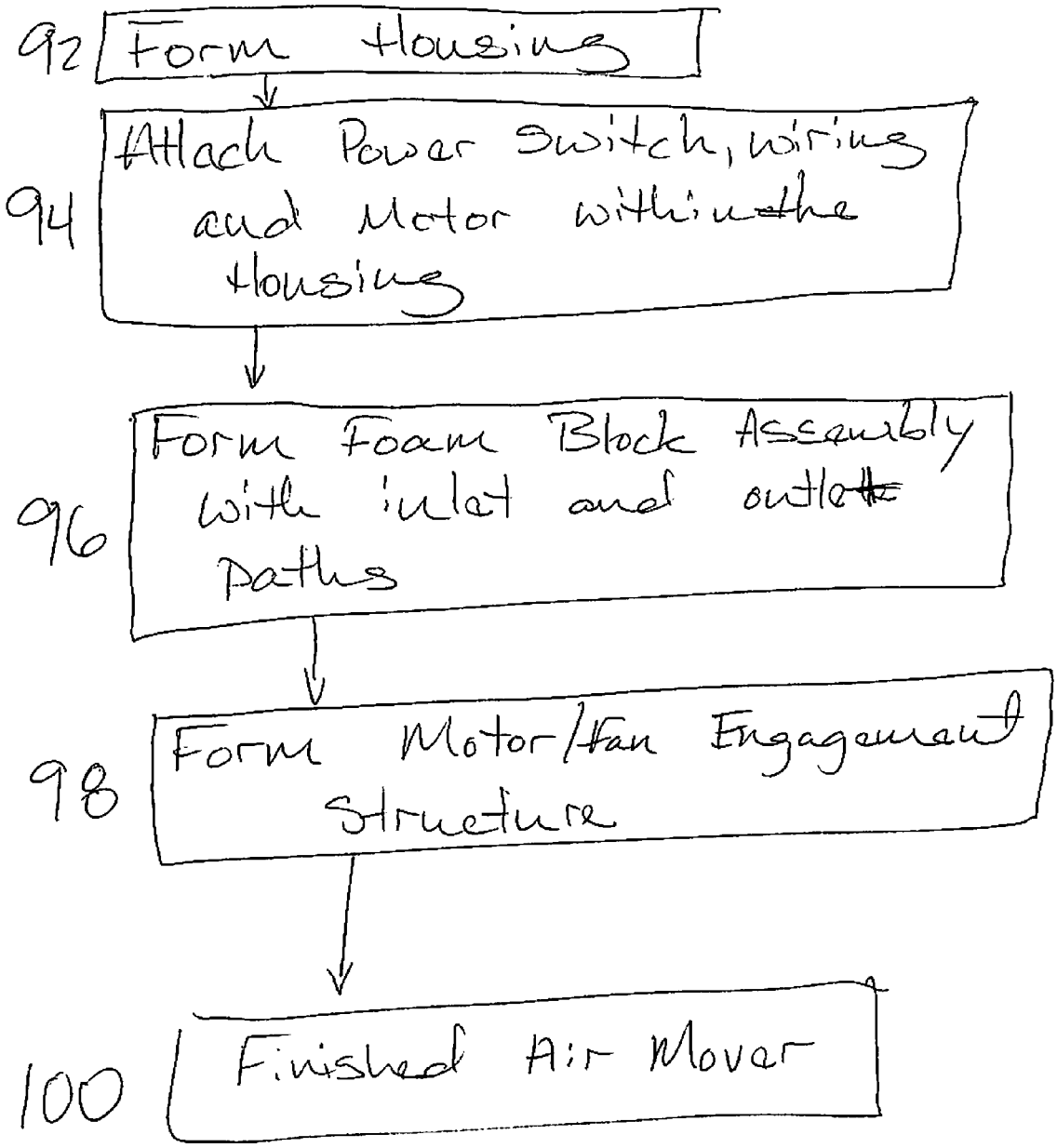
FIG. 9 is a logic diagram for the method of constructing the air moving device by forming the foam block assembly within the device housing.

FIG. 9 is a logic flow diagram that illustrates a method of constructing the air moving device. Step 92 is the start of the process of forming the device housing. The next step 94 is installing the power switch and wiring to the motor/fan assembly and placing the motor/fan assembly within the device housing. Step 96 involves forming the block assembly with air inlet and outlet paths. This step can be accomplished within the device housing by way of injecting the foam block material into the housing and around the other components of the device such as the motor/fan assembly. In step 98, a motor/fan engagement structure is formed around the motor/fan assembly as the foam solidifies. In step 100 the device housing is sealed and the air moving device is completed.

The exemplary embodiments shown in the figures and described above illustrate but do not limit the invention. It should be understood that there is no intention to limit the invention to the specific form disclosed; rather, the invention is to cover all modifications, alternative constructions, and equivalents falling within the spirit and scope of the invention as defined in the claims. For example, while the exemplary embodiments illustrate a functional encapsulation vacuum, the invention is not limited to use as a vacuum and may be embodied in other configurations and used for other purposes of than as a vacuum. While the invention is not limited to use as vacuum, it is expected that various embodiments of the invention will be particularly useful in such devices. Hence, the foregoing description should not be construed to limit the scope of the invention, which is defined in the following claims.

While there is shown and described the present preferred embodiment of the invention, it is to be distinctly understood that this invention is not limited thereto but may be variously embodied to practice within the scope of the following claims. From the foregoing description, it will be apparent that various changes may be made without departing from the spirit and scope of the invention as defined by the following claims.

The invention claimed is:

1. A method for manufacturing an air moving device, comprising the steps of:

forming an air moving device housing with at least two pieces and with a front side and a back side, for enclosing components of said air moving device, said air moving device housing having an air inlet port and an air outlet port, a thickness from front to back, and said housing having an air conveying chamber and a dust bag chamber;

forming a compressible foam block assembly, said compressible foam block assembly occupying said air flow chamber and having a front to back thickness greater then the front to back thickness of said air conveying chamber, thus requiring compression to fit within said device housing, with said compressible foam block assembly defining an air path in said foam, and having an air inlet path and an air outlet path which are linked together by an air conveying chamber through said block assembly;

forming a filter assembly with a particulate filter, said filter assembly configured to fill said filter chamber in said housing and operatively connected to said air path and a motor, forming a motor/fan engagement structure within said foam block assembly, with said motor/fan engagement structure configured for positioning a motor/fan assembly in said compressible foam block between said air inlet path and said air outlet path in said air conveying chamber of said block assembly;

inserting a motor/fan assembly into said motor/fan engagement structure in said compressible foam block;

attaching a power switch to said air moving device housing, and wiring said power switch to said motor/fan assembly within said block assembly; and installing a connection to a power source to said power switch and connecting said power switch to said motor/fan assembly; and placing said compressible foam block assembly within said air moving device housing so that said air inlet path of said block assembly accesses is operatively connected to said particulate filter and said air inlet port of said air moving device housing and placing said block assembly within said air moving device housing so that said air outlet path of said block assembly accesses is operatively connected to said outlet port of said air moving device housing.

2. The method for manufacturing an air moving device of claim 1 in which the step of forming said block assembly further comprises constructing said block assembly with a first foam block and a second foam block.

3. The method for manufacturing an air moving device of claim 2, in which the step of forming said first foam block and said second foam block further comprises pressing said first foam block and said second foam block together around a motor/fan assembly to secure and support said motor/fan assembly.

4. The method for manufacturing an air moving device of claim 2, in which the step of forming said first foam block and said second foam block further comprises forming a motor/fan engagement structure into the faces of said first foam block and said second foam block, for securing and supporting said motor/fan engagement structure holding said motor/fan assembly between said air inlet path and said air outlet path of said air conveying chamber of said compressible foam block assembly.

5. The method for manufacturing an air moving device of claim 2, in which the step of forming said first foam block and said second foam block further comprises forming said first foam block and said second foam blocks so when said faces of said first foam block and said second foam block are joined together, said compressible foam block assembly defines said air conveying chamber, said inlet path, and said outlet path.

6. The method for manufacturing an air moving device of claim 2, in which the step of forming said first foam block and said second foam block further comprises forming faces of said first foam block and second foam block to interfit with said motor/fan assembly with an airtight seal, with said seal becoming tighter when said first foam block and second foam block are compressed and fitted into said air moving housing.

7. The method for manufacturing an air moving device of claim 1, in which the step of forming said air moving device housing further comprises forming said air moving device housing in two pieces for fitting together around said compressible foam block assembly; wherein said compressible foam block assembly supports and encapsulates said motor/fan assembly.

8. The method for manufacturing an air moving device of claim 1, in which the step of forming the compressible foam block assembly further comprises forming said air conveying chamber in a serpentine in shape in order to absorb sound.

9. The method for manufacturing an air moving device of claim 1, further comprising forming one or more orienting tabs in said motor/fan engagement structure for holding said motor/fan assembly stationary by contacting the interior of said compressible foam block assembly for and resisting torque generated movement of said motor/fan relative to said interior of said block assembly while said motor/fan assembly is in operation.

10. A method of manufacturing an air moving device comprising the steps of:

forming an air moving device housing, for enclosing components of said air moving device, said air moving device having an air inlet port and an air outlet port;

forming a block assembly comprising a first and second block of compressible foam, said block assembly having an air inlet path and an air outlet path which are linked together by an air conveying chamber through said block assembly in which said device housing, said first foam block and said second foam block further comprise a close fit design; said device housing, said first foam block and said second foam block, when assembled together, accommodate other components of said air moving device such as wiring, circuit boards, filters, structural dividers and an air transmitting refuse collector;

forming a motor/fan engagement structure within said block assembly, with said motor/fan assembly between said air inlet path and said air outlet path in said air conveying chamber of said block assembly;

attaching a power switch to said air moving device housing, and wiring said power switch to said motor/fan assembly within said block assembly;

installing a connection to a power source to said power switch;

placing said block assembly within said air moving device housing so that said air inlet path of said block assembly accesses said air inlet port of said air moving device housing;

placing said block assembly within said air moving device housing so that said foam blocks secure said motor/fan as said blocks are compressed, with said air outlet path of said block assembly in communication with said outlet port of said air moving device housing with said components of said air moving device tightly interlocking so as to eliminate the need for fasteners;

placing said air transmitting refuse collector between said air inlet port of said air moving device housing and said air inlet path of said block assembly; and placing a particulate filter between said air outlet port of said air moving device housing and said air outlet path of said block assembly.

* * * * *